US007034765B2

(12) United States Patent
Fischer et al.

(10) Patent No.: US 7,034,765 B2
(45) Date of Patent: Apr. 25, 2006

(54) COMPACT MULTIPLE-BAND ANTENNA ARRANGEMENT

(75) Inventors: Georg Fischer, Bavaria (DE); Florian Pivit, Tullastrasse (DE)

(73) Assignee: Lucent Technologies Inc., Murray Hill, NJ (US)

( * ) Notice: Subject to any disclaimer, the term of this patent is extended or adjusted under 35 U.S.C. 154(b) by 14 days.

(21) Appl. No.: 10/677,280

(22) Filed: Sep. 30, 2003

(65) Prior Publication Data

US 2005/0068239 A1 Mar. 31, 2005

(51) Int. Cl.
*H01Q 13/10* (2006.01)
*H01Q 13/12* (2006.01)

(52) U.S. Cl. ..... 343/770; 343/769

(58) Field of Classification Search ..... 343/770, 343/767, 700 MS, 729, 769; H01Q 13/12, H01Q 13/10
See application file for complete search history.

(56) References Cited

U.S. PATENT DOCUMENTS

| | | | | |
|---|---|---|---|---|
| 4,131,894 | A | 12/1978 | Schiavone | 343/700 |
| 4,614,947 | A | 9/1986 | Rammos | 343/700 |
| 4,684,953 | A * | 8/1987 | Hall | 343/725 |
| 5,119,107 | A * | 6/1992 | Wildey et al. | 343/770 |
| 5,453,751 | A * | 9/1995 | Tsukamoto et al. | 343/700 MS |
| 6,175,333 | B1 | 1/2001 | Smith et al. | 343/700 |
| 6,288,679 | B1 | 9/2001 | Fischer et al. | 343/700 |

FOREIGN PATENT DOCUMENTS

| | | |
|---|---|---|
| EP | 0 252 779 A1 | 6/1987 |
| EP | 0 123 350 B1 | 9/1987 |
| EP | 0252779 | 1/1988 |
| EP | 0 252 779 B1 | 10/1993 |

OTHER PUBLICATIONS

Rammos, E., "*New Wideband High-Gain Stripline Planar Array for 12 GHz Satellite TV*," Electronics Letters, Feb. 4, 1982, 2 pages.
Ramos, E., "*Suspended-Substrate Line Antenna Fits 12-GHz Satellite Applications*," MSN, Mar. 1984, pp. 110-126.
Halpern, B.M., et al., "*The Monopole Slot as a Two-Port Diversity Antenna for UHF Land-Mobile Radio Systems*," IEEE Transactions on Vehicular Technology, vol. VT-33, No 2, May 1984.
European Search Report dated Mar. 15, 2004.

* cited by examiner

*Primary Examiner*—Hoanganh Le
(74) *Attorney, Agent, or Firm*—M. I. Finston

(57) ABSTRACT

An antenna element is provided which responsive in multiple frequency bands, has symmetric beam patterns, and is easily and cheaply fabricated. The antenna element includes at least three conductive plates arranged in a stack At least one pair of adjacent plates contain apertures that are mutually aligned relative to the stacking direction. The antenna element further includes at least one air stripline arranged to create radiative electromagnetic excitations of the apertures when the stripline or striplines are energized by a suitable radiofrequency voltage source or sources.

9 Claims, 10 Drawing Sheets

MEASURED
SIMULATION

MEASURED
SIMULATION

COMPACT MULTIPLE-BAND ANTENNA ARRANGEMENT

FIELD OF THE INVENTION

This invention relates to antenna designs for wireless communication, and more particularly to the design of antenna elements that can be used in more than one frequency band.

ART BACKGROUND

As wireless communication technology continues to develop, it is inevitable that emerging wireless services will coexist with established services for at least some period of time. For example, some parts of the world already see, or will soon see, UMTS service coexisting with GSM. One way for wireless service providers to save money, at least in such interim periods, is to install base station equipment that is suitable for use in multiple frequency bands, which include the bands of both the established and the emerging services. In particular, it will be useful to install antennas suitable for use in more than one frequency band.

Multiple-band antennas are known. However, at least some of these antennas are relatively expensive because they have relatively many components which furthermore comprise several different construction materials. Moreover, currently available multiple-band antennas are typical constructed from several elements, each element corresponding to a distinct frequency band of operation. Such construction from multiple elements is generally disadvantageous because it leads to overall antennas that are ungainly and visually obstructive, and because it may also lead to antennas having asymmetric beam patterns.

SUMMARY OF THE INVENTION

The present invention provides a single antenna element that is responsive in multiple frequency bands, has symmetric beam patterns, and is easily and cheaply fabricated.

In a broad aspect, the invention involves an antenna element comprising at least three conductive plates arranged in a stack At least one pair of adjacent plates contain apertures that are mutually aligned relative to the stacking direction. The antenna element further includes at least one air stripline arranged to create radiative electromagnetic excitations of the apertures when the stripline or striplines are energized by a suitable radiofrequency voltage source or sources.

In specific embodiments of the invention, the plate at one end of the stack is not apertured. Such a non-apertured plate reflects radiofrequency energy and thereby adds directionality to the beam pattern of the antenna element.

In specific embodiments of the invention, at least two apertures are differently sized, thereby to make resonant operation possible in at least two frequency bands.

DETAILED DESCRIPTION

Figure 1:
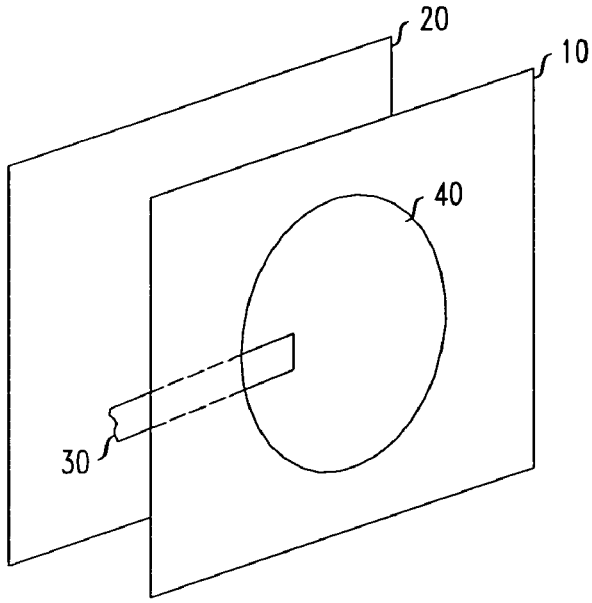
FIG. 1 (PRIOR ART)
FIG. 1 is a conceptual drawing of a circular aperture antenna element of the prior art.

A circular aperture antenna element is known. With reference to FIG. 1, such an element includes apertured plate 10 spaced apart from, and aligned with, parallel solid, i.e., unapertured, plate 20. Plates 10 and 20 are electrically conductive. By way of example, they are cut or stamped from sheets of a conductive metal such as aluminum, copper, or brass. Alternatively, plates 10 and 20 can be made from a non-conductive material of sufficient thickness and rigidity to provide adequate structural support, overlain by or laminated with a layer of conductive metal. As is known, any thickness of metal is acceptable, provided it is great enough to avoid skin effects at the frequency of operation of the antenna element. By "conductive plate," we mean a plate structure of any of the kinds described above.

Also included in the circular aperture antenna element of FIG. 1 is air stripline 30. Stripline 30 is situated between plates 10 and 20, and protrudes partway into the volume underlying aperture 40 of plate 10. It is advantageous to situate stripline 30 nearer to plate 10 than to plate 20, because this tends to make plate 10 behave as a groundplane for the stripline, and it tends to promote good coupling to the aperture in plate 10.

Aperture 40, in operation as, e.g. a radiator of radiofrequency energy, has at least one resonant wavelength which can be used as the center wavelength for the operative band of the antenna. The resonant wavelengths $\lambda_{res}$ at the two lowest resonant frequencies of aperture 40 are related to diameter D of the aperture by:

$$\lambda_{res} = \frac{\pi D}{1.8}, \lambda_{res} = \frac{\pi D}{2.4}.$$

Preferably, only the fundamental mode is excited, so that only one antenna pattern is dominant.

The bandwidth for resonant operation of the antenna is about 12% relative to the center frequency $$f_{res} = \frac{c}{\lambda_{res}},$$

where c is the vacuum velocity of light.

The separation between plates 10 and 20 is desirably $$\frac{\lambda}{4},$$

as measured between facing conductive surfaces, to ensure that plate 20 is an effective reflector for the aperture.

Stripline 30 is constructed as a conductive wire or strip bearing signal voltages, situated between plates 10 and 20. The antenna impedance is determined by the length of stripline that protrudes into the volume defined by aperture 40. Typically, a 50-Ω stripline is used, and a sufficient length of stripline extends into the aperture region to provide a matching antenna impedance of 50 Ω.

Plates 10 and 20 are both maintained at electrical ground potential. Consequently, both plates are conveniently supported by metal rods or other metal support structures.

Although useful, the antenna element of FIG. 1 has limited applications because of its relatively narrow bandwidth which, as noted above, is about 12% relative to the resonant frequency. Thus, for example, a single antenna element of the kind illustrated in FIG. 1 cannot function effectively to provide multiple-band wireless transmission or reception in, for example, both an 850 MHz band and a 1900 MHz band. Instead, an additional antenna element, scaled to the second frequency band, would have to be provided. If, however, it is necessary to provide multiple elements, some of the inherent advantages of this type of antenna element, e.g. compactness and inexpensive fabrication, are lost.

We have solved this problem, among others, by providing an aperture-type antenna element constructed from three or more plates.

Figure 2:
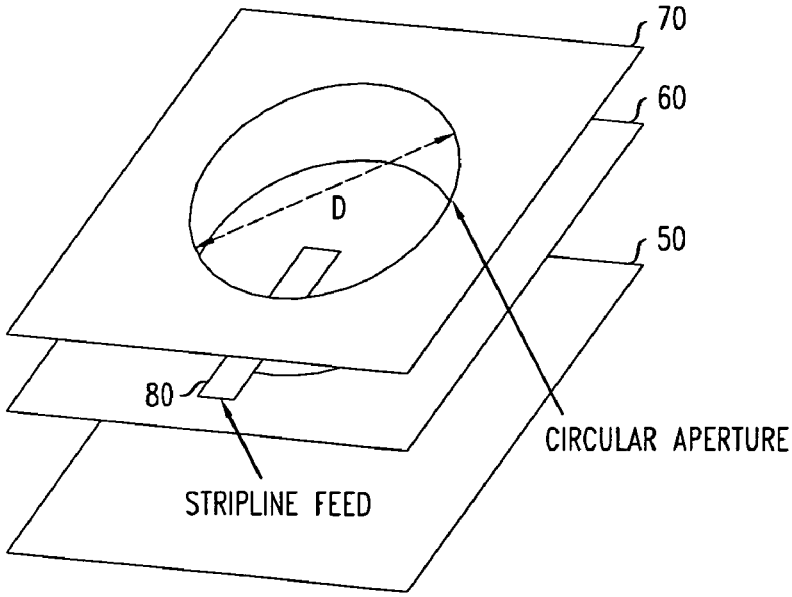
FIG. 2 is a conceptual drawing of an antenna element having three plates, according to the present invention in an exemplary embodiment.

One example of our new antenna element is illustrated in FIG. 2. There, it is seen that the antenna element includes three plates, respectively indicated by the reference numerals 50, 60, and 70. It will be seen that plate 50 is the unapertured, reflective plate, and plates 60 and 70 have identical, mutually aligned apertures. Stripline 80 is inserted in the midplane between the two apertured plates, and as above, extends far enough into the aperture region to impart the desired antenna impedance.

Importantly, the bandwidth of the antenna element of FIG. 2 is quite broad due to coupling between the two apertures.

Figure 3:
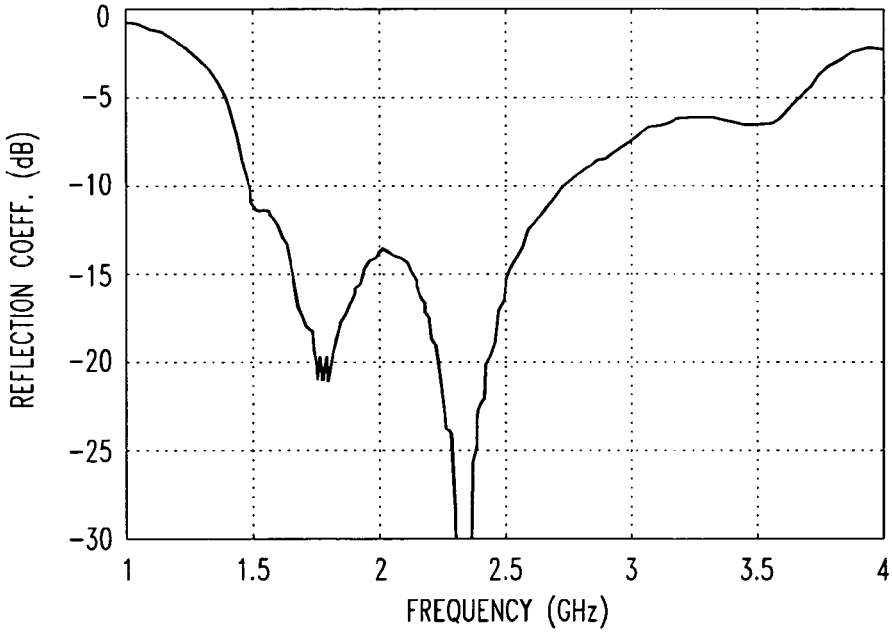
FIG. 3 is a graph of the measured input reflection coefficient for a prototype of the antenna element of FIG. 2.

In fact, it is not the apertures per se, but rather the coupling between the stripline and the paired apertures that primarily limits the bandwidth. The frequency-dependent behavior of this coupling is illustrated in FIG. 3 for a prototype of the antenna element of FIG. 2 which we made from brass sheets. The measured input reflection coefficient of our prototype is plotted versus frequency in FIG. 3. It will be seen that resonant inverse peaks occur at approximately 1.75 GHz and 2.26 GHz. These peaks occur at or slightly below the resonant frequencies predicted (by the theory of infinite short circular waveguides) to occur at $$f = \frac{1.8\,c}{\pi d} \text{ and } f = \frac{2.4c}{\pi d}.$$

Importantly, it will be seen from the graph of FIG. 3 that the reflection coefficient lies at or below −10 dB over the frequency range from 1.5 GHz to 2.7 GHz. In general, there will be adequate matching of the antenna feed to the radiative apertures over that frequency range.

Figure 4:
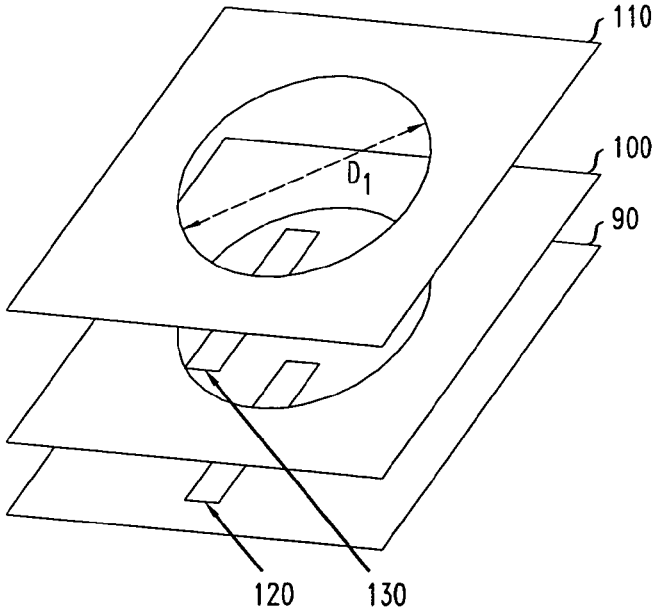
FIG. 4 is a conceptual drawing of an antenna element having three plates and two apertures of different sizes, according to the present invention in a further exemplary embodiment.

A second exemplary embodiment of our new antenna element is illustrated in FIG. 4. There, it will be seen that as in FIG. 2, there is an unapertured plate 90 and two apertured plates, here indicated by the reference numerals 100 and 110. Unlike the embodiment of FIG. 2, the plates 100 and 110 here have apertures of different sizes, with the smaller aperture situated nearer unapertured plate 90. We have found it advantageous to feed such an arrangement with two striplines, here indicated by the reference numerals 120 and 130. Stripline 120 is situated in the midplane between plates 90 and 100, so as to primarily feed the aperture of plate 100. Stripline 130 is situated in the midplane between plates 100 and 110. Because plate 100 will generally function, at least partially, as a reflector for the radiating aperture of plate 110, stripline 130 will primarily feed the aperture of plate 110.

By using two apertures having different diameters, we have been able to extend the frequency response of the antenna element. For example, we constructed a prototype of the antenna element of FIG. 4 from brass plates. The smaller aperture was sized for optimum response (as predicted by the theory referred to above) in the 1800 MHz band and the 2100 MHz band, and the larger aperture was sized for optimum response in the 900 MHz band. In operation, stripline 120 would typically deliver the 1800 MHz and 2100 MHz signals, and stripline 130 would typically deliver the 900 MHz signal. By "deliver" in this regard is meant to provide a feed signal when the antenna is to be used in transmission, and to provide an antenna response to a receiver when the antenna is to be used in reception.

Figure 5:
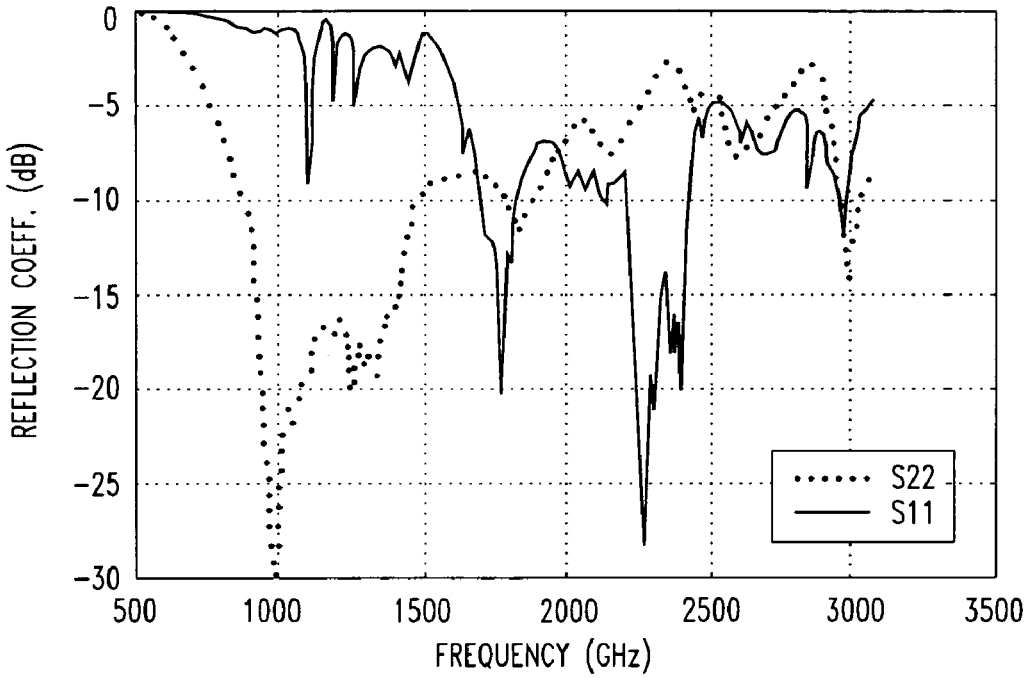
FIG. 5 is a graph of the measured input reflection coefficient for a prototype of the antenna element of FIG. 4.

We measured the reflection coefficients, versus frequency, of our prototype of the antenna element of FIG. 4. Our measurements are graphed in FIG. 5, where the lower curve represents measurements made with respect to stripline 120, and the upper curve represents measurements made with respect to stripline 130. It will be seen from the graph of FIG. 5 that inverse resonant peaks occurred at approximately 1100 MHz, 1750 MHz, and 2250 MHz. This shows that multiband operation is possible, in bands centered near each of the three peaks. An especially wide band of operation is possible near the 1 100-MHz peak, potentially extending from 850 MHz, or even less, to 1450 MHz, or even more.

It should be noted that polarization diversity is conveniently provided by orienting two striplines in orthogonal directions. This is readily achieved by, for example, situating two orthogonal striplines in a common midplane between plates. The same arrangement is also convenient for the production of circular polarization using, e.g., a four-port hybrid according to well-known techniques.

Figure 16:
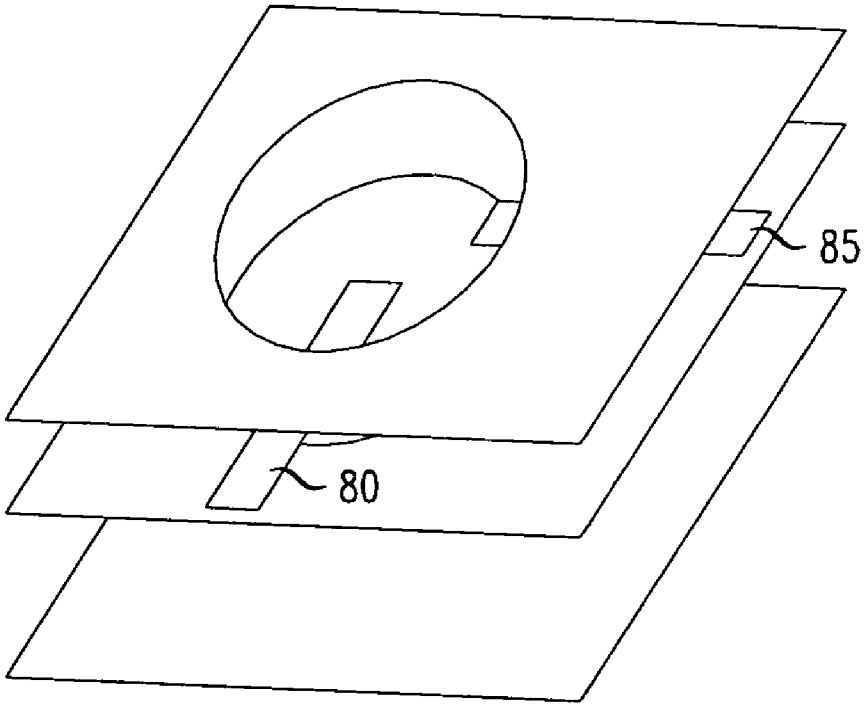
FIG. 16 is a conceptual drawing of an antenna element including a pair of mutually perpendicular stripline conductors according to the present invention in a further exemplary embodiment.

An arrangement including a pair of mutually orthogonal striplines 80, 85 is shown in FIG. 16

Still greater polarization diversity is conveniently provided by adding a vertical radiator that is oriented perpendicular to the plates and passes through the centers of the apertures. The vertical radiator is typically a rod or a stack or cluster of rods arranged according to well-known principles of antenna design. The vertical radiator can serve as a dipole radiator having a third polarization direction orthogonal to the two polarization directions available from the radiating apertures. We here intend the term "vertical radiator" to apply not only when the described arrangement is used for tranmission, but also when it is used for reception of electromagnetic signals.

Figure 6:
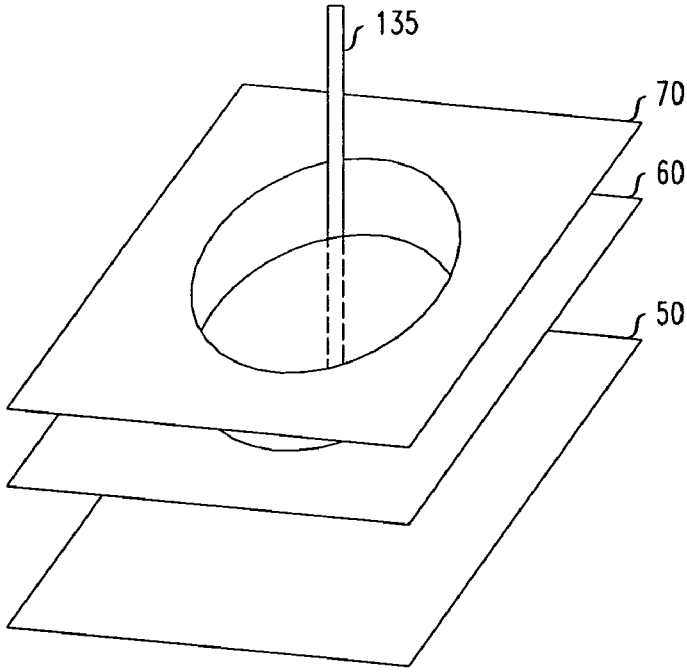
FIG. 6 is a conceptual drawing of an antenna element including a vertical radiator, according to the present invention in a further exemplary embodiment.

FIG. 6 shows an antenna arrangement like that of FIG. 2, but further including a vertical radiator 135. Reference numerals common to FIGS. 2 and 6 refer to features common to the two figures. For clarity, the stripline feed has been omitted from FIG. 6.

As seen in FIG. 6, vertical radiator 135 is fed through a small hole in the center of the reflector plate, and isolated therefrom. The centers of the apertures have zero impedance with respect to the stripline feeds, and there is zero field strength at the centers of the apertures. Therefore, the presence of the vertical radiator will cause little or no distortion of the field of the apertures. It should be noted that whereas excitation of the apertures produces electric field components which are transverse, relative to the plates, excitation of the vertical radiator produces a longitudinal electric field, i.e., a field substantially directed in the direction perpendicular to the plates.

Figure 7:
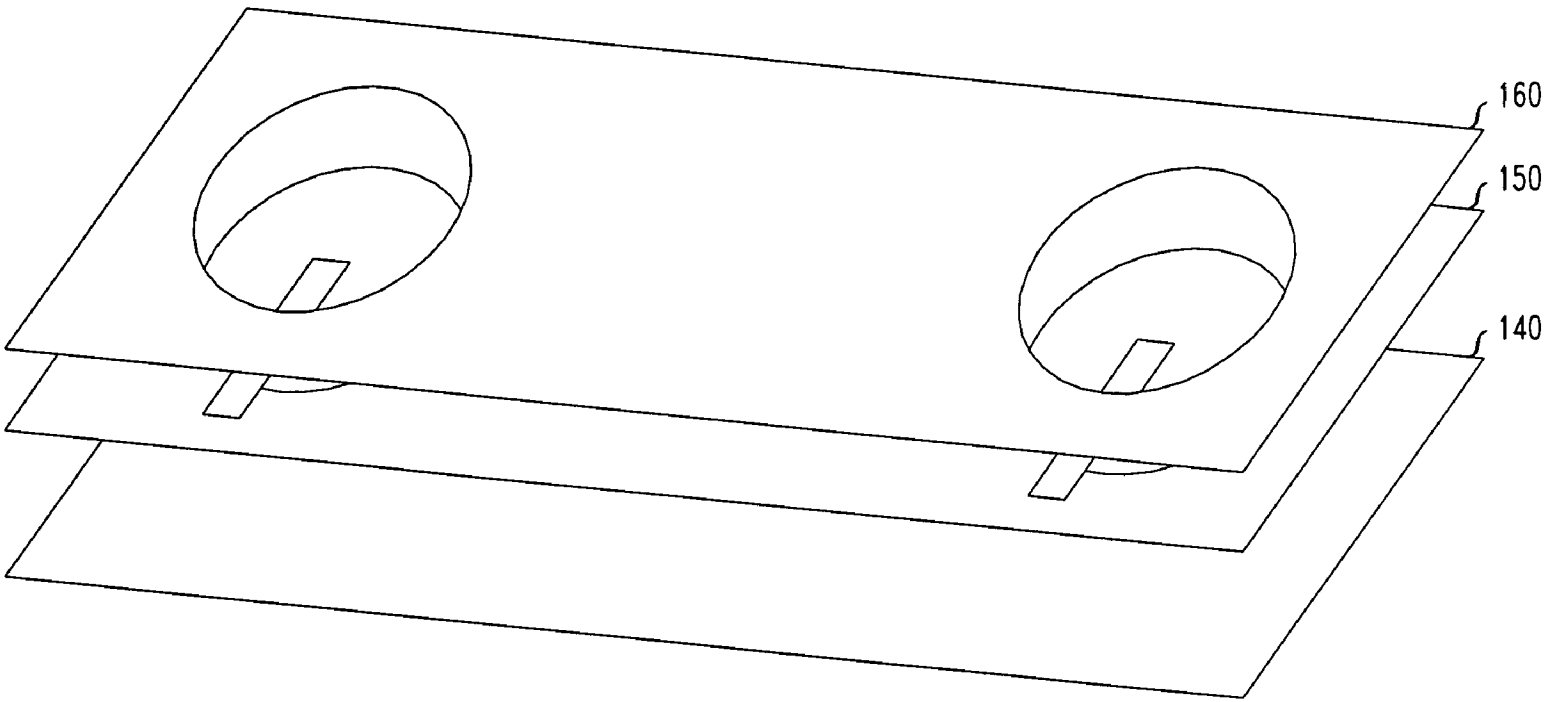
FIG. 7 is a conceptual drawing of an antenna element having plates with multiple apertures, according to the present invention in a further exemplary embodiment.

In other embodiments of the invention, one or more of the plates may contain two or more apertures, each fed by a respective stripline. For example, FIG. 7 shows an antenna element in which plate 140 is unapertured, plate 150 has two apertures, and plate 160 has two apertures matched to, and aligned with, the apertures in plate 150.

In the preceding discussion, it has been assumed that the radiating apertures are round. However, it is also envisaged that in some embodiments of the present invention, the apertures may assume elliptical, rectangular, or other shapes other than cruciform slots. In such cases, a pair of apertures in adjacent plates will be considered to be "aligned" if their respective centroids are aligned along an axis perpendicular to the plates.

For example, elliptical apertures will be useful for purposes of beam-forming. That is, the beam-in the direction of the major axis of the ellipse will be narrower than the beam in the direction of the minor axis.

In the preceding discussion, it has been assumed that the plates are flat. However, it is also envisaged that some embodiments of the present invention will use a conformal antenna arrangement, in which the plates have some curvature while remaining parallel to each other.

The exemplary embodiments depicted in FIG. 2 and FIG. 4 have three plates, i.e., an unapertured reflector plate and two apertured plates. However, it is important to note that the invention is not limited to embodiments having three plates. Within practical limits, it will be possible to add, after the reflector plate, as many apertured plates as the desired number of operating frequency bands. The smallest aperture should be formed in the apertured plate nearest the reflector plate, and the size of the aperture should increase as successive plates are added, so that only smaller apertures lie between any given aperture (after the first) and the reflector plate.

For convenience, and not by way of limitation, we will refer to the position of the unapertured reflector plate as the "bottom" of the stack of plates. Likewise, we will refer to the direction along the stack away from the reflector plate as "upward", and the opposite direction as "downward". If round apertures are involved, "larger" means larger in diameter. If a plurality of apertures are involved which are geometrically similar but not round, then "larger" refers to any appropriate scale factor, such as major or minor axis of an elliptical aperture.

If the number of apertured plates is relatively small, e.g. two or three, and the respective apertures are relatively close in diameter, e.g., within 15% of each other, the reflector plate will, to at least some extent, be an effective reflector for each of the apertures. On the other hand, as the number of apertured plates increases, it is possible that radiation from some of the apertures situated farthest from the reflector plate will be affected more by the cumulative reflective effects of the underlying apertured plates than by the reflector plate.

If two successive apertures are substantially different in diameter, e.g., different by a factor of two, the lower plate, which has the smaller-diameter aperture, will be an effective reflector for the aperture in the upper plate. This will be true even if there are as few as two apertured plates.

The precise degree to which a given plate is an effective reflector for given aperture lies on a continuum. In practice, it will generally be ascertained from numerical simulations.

The vertical positioning of each apertured plate in the stack is advantageously determined by a two-step process. Initially, the designer identifies that plate which is the predominant effective reflector for the aperture of interest. An initial estimate of the distance between the effective reflector and the aperture is one-fourth the center wavelength of the desired operating band for that aperture. (For idealized reflections, this quarter-wavelength rule assures that reflections returned to the aperture from the reflector plate will interfere constructively with forward-emitted radiation from the aperture.) Then, the position of the aperture is fine-tuned through numerical simulation.

EXAMPLE

As noted above, we constructed prototype antenna elements of the kinds depicted in FIGS. 2 and 4. The plates were stamped from 150-mm-square brass sheets 0.5 mm in thickness.

In the element of FIG. 2, the aperture diameters were both 90 mm. The lower apertured plates was spaced 38 mm from the reflector plate, as measured from the center of the aperture.

In the element of FIG. 4, the aperture diameters and the positions of the apertured plates relative to the reflector plate were optimized for performance in the designated frequency bands.

As noted above, we measured the frequency dependence of the feed-signal reflection coefficient for the single feed of the antenna element of FIG. 2, and for the two feeds of the antenna element of FIG. 4. The results are plotted in FIGS. 3 and 5, respectively, and are discussed above.

Figure 8:
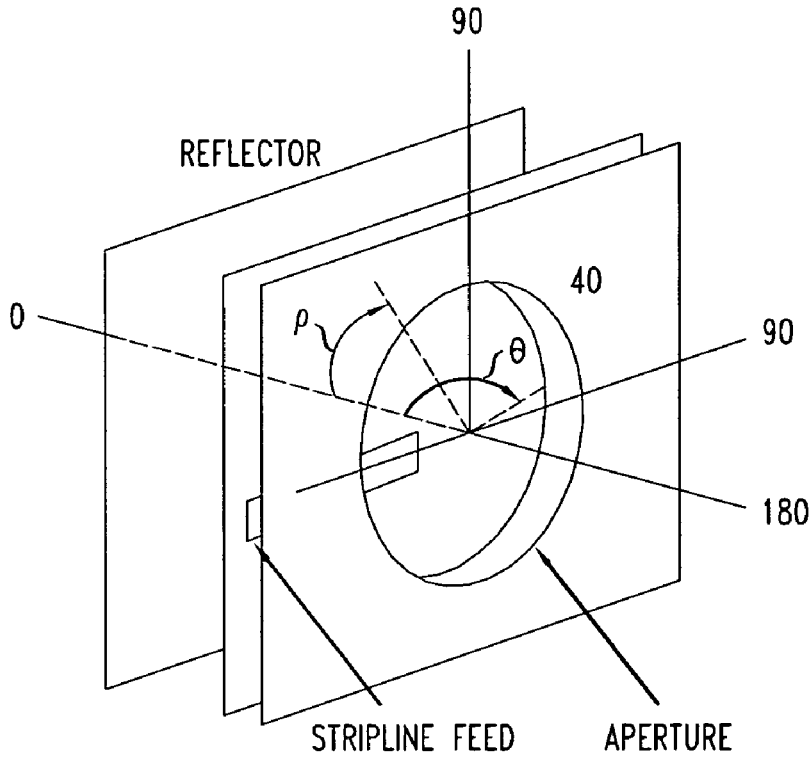
FIG. 8 is a conceptual drawing of a circular-aperture antenna element on which is superposed the coordinate system used for reference in the graphs of FIGS. 9–12.
Figure 10:
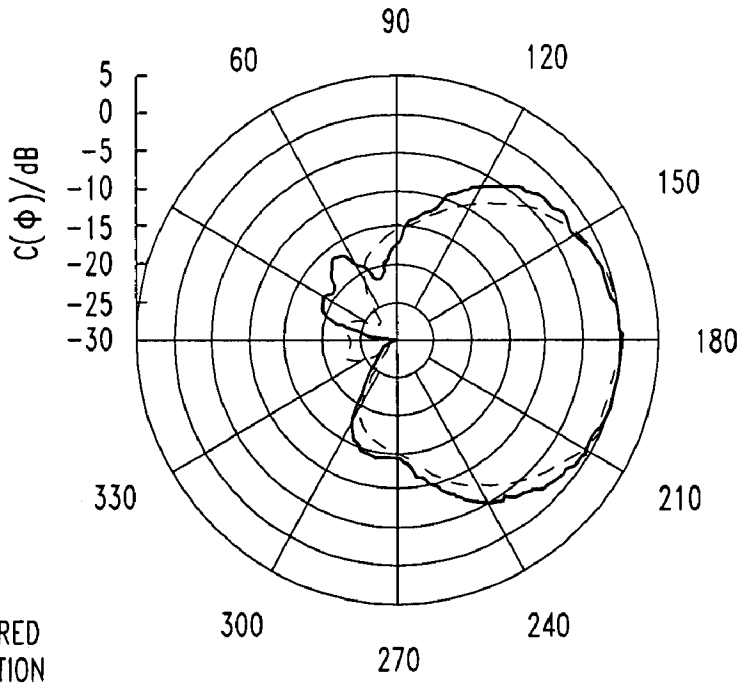
FIGS. 9 and 10 are graphs of, respectively, the vertical and horizontal characteristics of the antenna element of FIG. 2 at a frequency of 1800 MHz.
Figure 9:
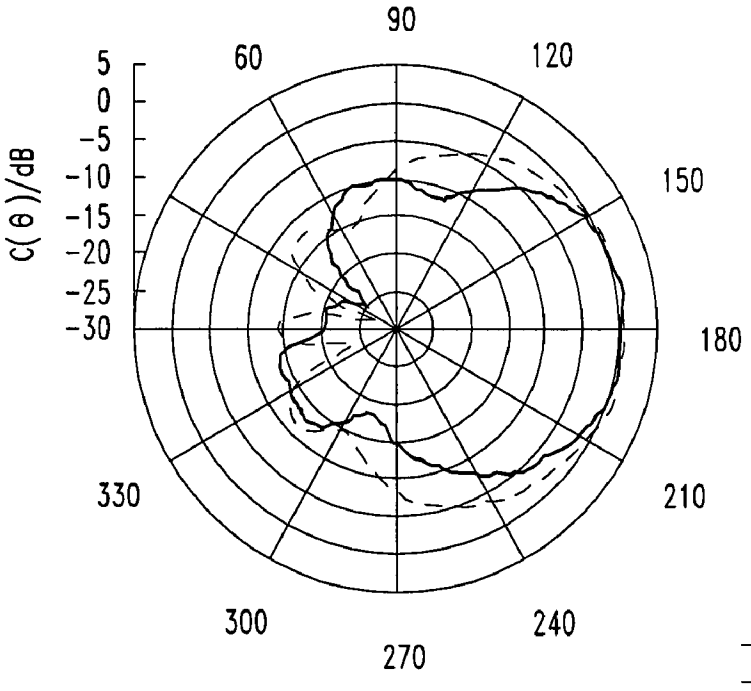
Figure 12:
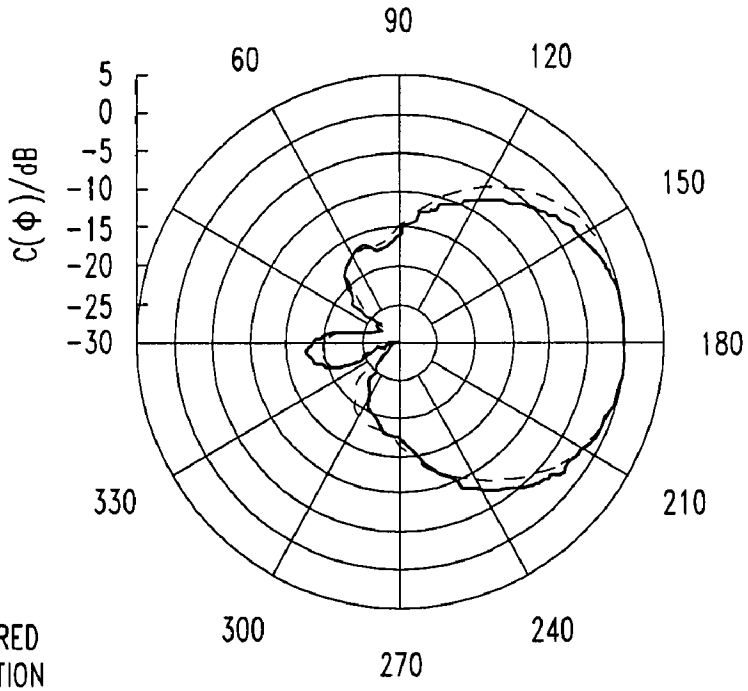
FIGS. 11 and 12 are graphs of, respectively, the vertical and horizontal characteristics of the antenna element of FIG. 2 at a frequency of 2100 MHz.
Figure 11:
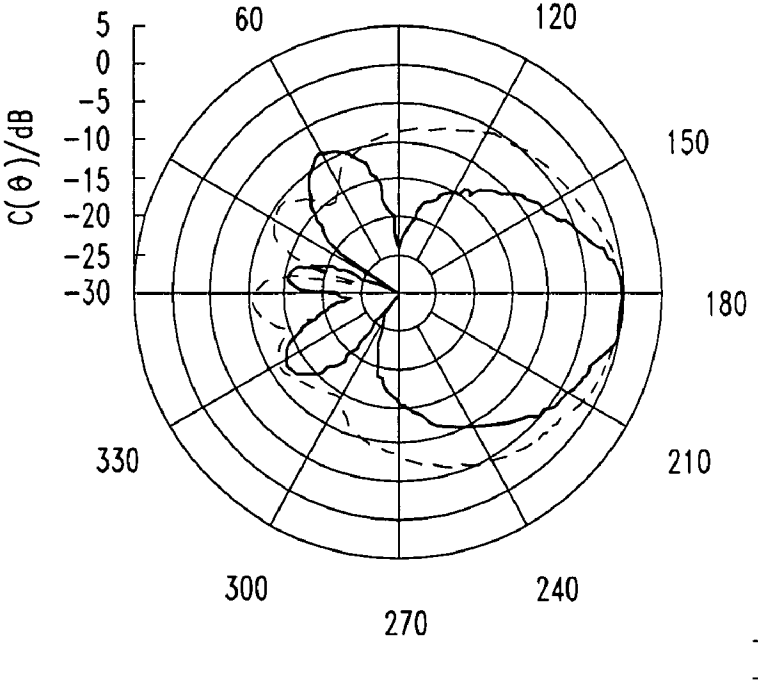

We also measured antenna characteristics (i.e., sensitivity or radiation patterns) for our prototype of the antenna element of FIG. 2 at two different frequencies. FIG. 8 illustrates the coordinate system used in graphing the results of these measurements. FIGS. 9 and 10 are, respectively, the vertical and horizontal characteristics of the antenna element of FIG. 2 at a frequency of 1800 MHz. FIGS. 11 and 12 are, respectively, the vertical and horizontal characteristics of the same antenna element at a frequency of 2100 MHz. It will be seen from FIGS. 9 and 10 that at 1800 MHz, the prototype had a vertical beam width (at the −3 dB level) of 80 degrees, and a horizontal beam width of 115 degrees. It will be seen from FIGS. 11 and 12 that at 2100 MHz, the prototype had a vertical beam width of 55 degrees and and horizontal beam width of 80 degrees. Although the width of the horizontal beam is reduced at the higher frequency, it remains greater than 120 degrees at the −10 dB contour.

Figure 13:
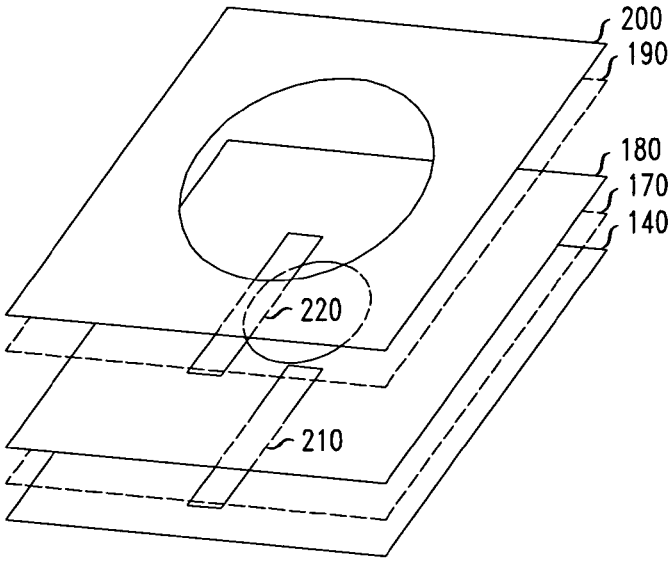
FIG. 13 is a conceptual drawing of an antenna element having more than three plates, according to the present invention in a further exemplary embodiment.

FIG. 13 shows an antenna element having reflector plate 140 and four apertured plates, indicated in the figure by the reference numerals 170, 180, 190, and 200. For simplicity, plates 190 and 170 are shown in outline only in the figure. Stripline 210 is positioned between plates 170 and 180, and stripline 220 is positioned between plates 190 and 200.

We constructed a prototype antenna element having the configuration shown in FIG. 13. Plates 200 and 190 contained apertures 180 mm in diameter, plates 180 and 170 contained apertures 90 mm in diameter, the two large apertures were separated by 24 mm, and the two small apertures were separated by 12 mm. The lowest aperture (i.e., the aperture in plate 170) was separated from reflector plate 160 by 38 mm. The lowest large aperture was separated from the highest small aperture by 80 mm.

Figure 14:
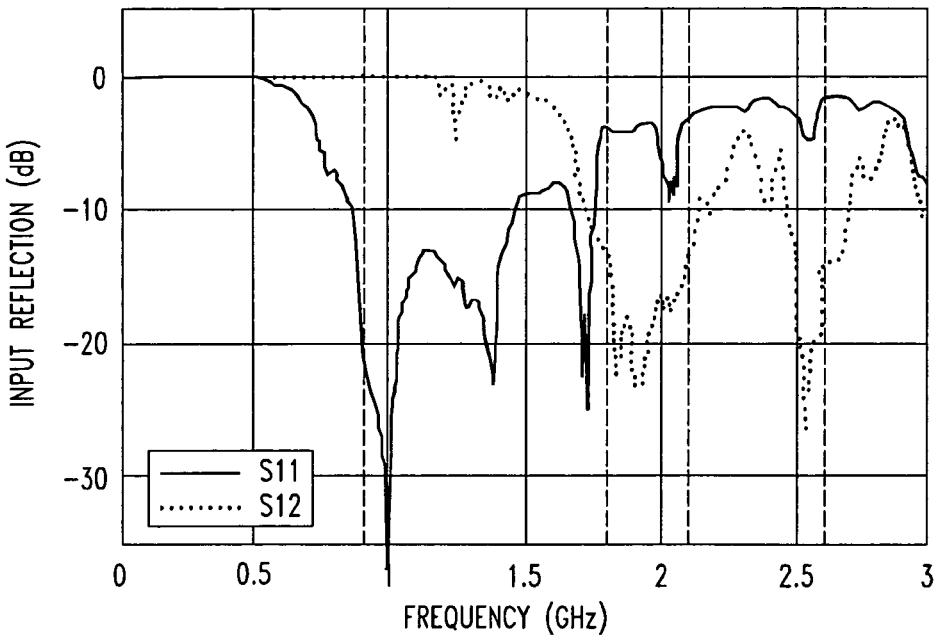
FIG. 14 is a graph of the input impedance, for each of the two input ports, of the antenna structure of FIG. 13.

FIG. 14 is a graph of the input impedance, for each of the two input ports, of the antenna structure of FIG. 13. It will be seen that the antenna element is matched to the GSM 900, GSM 1800, and UMTS frequency bands, as well as possibly a fourth band at 2600 MHz.

Figure 15:
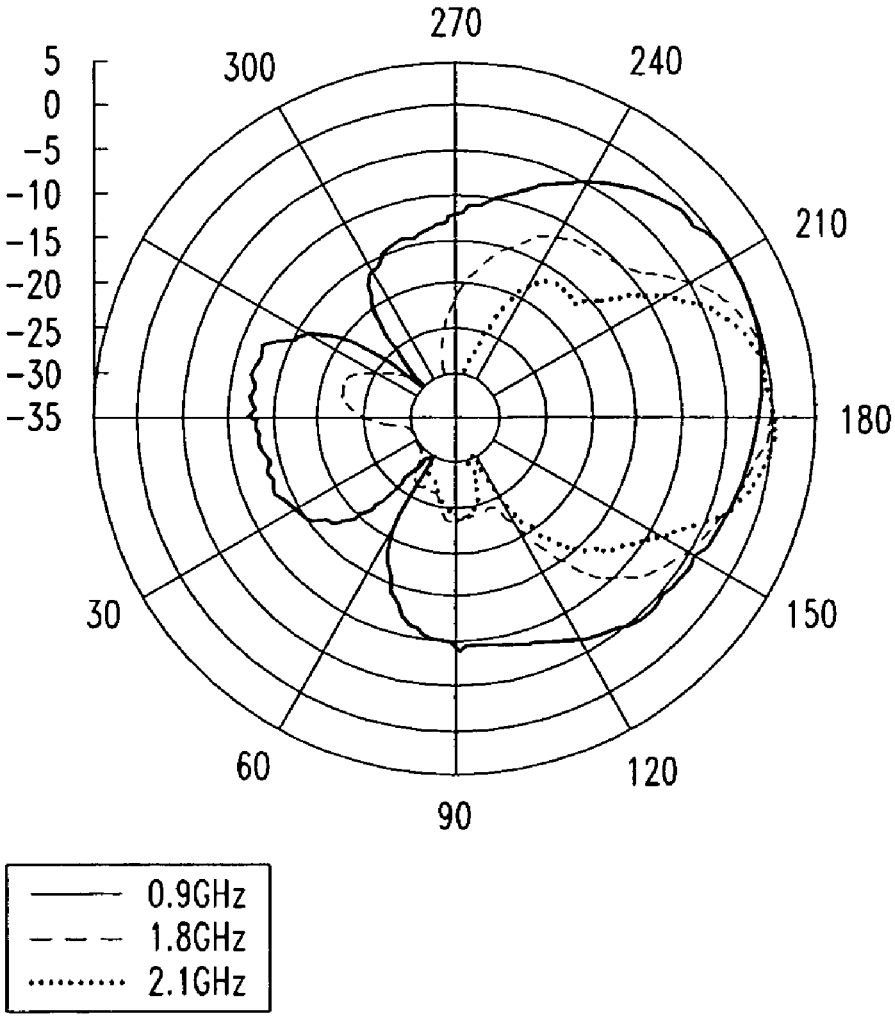
FIG. 15 is a graph of the horizontal pattern of the antenna structure of FIG. 13.

FIG. 15 is a graph of the horizontal pattern of the antenna structure of FIG. 13.

The invention claimed is:

1. An antenna element which comprises:

at least three substantially parallel electrically conductive plates, at least two of which are mutually adjacent and contain respective, mutually aligned apertures which differ in diameter by at least a factor of two; and at least a first and a second stripline conductor arranged to create radiative electromagnetic excitations of the apertures when at least one of said stripline conductors is driven by a suitable radiofrequency voltage source, wherein the striplines are arranged to be driven by a multiple-band radiofrequency source for a wireless base station, such that each stripline is driven in a distinct frequency band of wireless operation, and one said band of operation has a nominal frequency at least twice that of the other.

2. The antenna element of claim 1, wherein:

all of said plates, except for an endmost plate, contain respective, mutually aligned apertures; and the endmost plate is arranged to reflect electromagnetic energy radiated by at least one of the apertures.

3. The antenna element of claim 2, wherein the apertures in respective plates are geometrically similar to each other, at least two of said apertures are unequal in size, and given any pair of apertures of unequal sizes, the larger aperture is situated farther from the reflective endmost plate.

4. The antenna element of claim 3, wherein the apertures are circular, and each aperture has a radius selected for resonance at a particular frequency, the radius and resonant frequency being different for at least one pair of apertures.

5. The antenna element of claim 1, wherein each aperture is provided with its own corresponding stripline conductor.

6. The antenna element of claim 1, wherein at least one adjacent pair of apertures shares a common stripline conductor.

7. The antenna element of claim 1, wherein at least one aperture is provided with a pair of mutually perpendicular stripline conductors arranged to create two mutually orthogonal excitations of said aperture when said conductor pair is suitably energized.

8. The antenna element of claim 1, further comprising a vertical radiator centrally aligned with the apertures and arranged to support, when suitably energized, an electromagnetic excitation orthogonal to the aperture excitations.

9. The antenna element of claim 1, wherein:

at least one plate contains two or more apertures; and each of said two or more apertures is provided with a respective stripline conductor arranged to create a radiative electromagnetic excitation of the corresponding aperture when suitably energized.

* * * * *